United States Patent [19]

Elwing et al.

[11] Patent Number: 4,499,824

[45] Date of Patent: Feb. 19, 1985

[54] MACHINE FOR CRUSHING CYLINDRICAL ALUMINIUM CANS FOR BEER, SOFT DRINKS ETC.

[75] Inventors: Ben Elwing, Gislaved; Peter Földi, Forsheda; Göte Holmberg, Anderstorp, all of Sweden

[73] Assignee: Broderna Holmbergs Fabriks AB, Anderstorp, Sweden

[21] Appl. No.: 531,150

[22] Filed: Sep. 9, 1983

[30] Foreign Application Priority Data

Sep. 9, 1982 [SE] Sweden ..... 8205122

[51] Int. Cl.[3] ..... B30B 9/32

[52] U.S. Cl. ..... 100/48; 100/49; 100/52; 100/99; 100/104; 100/131; 100/215; 100/256; 100/269 R; 100/902; 194/4 C

[58] Field of Search ..... 100/902, 215, 269 R, 100/256, 48, 49, 50, 52, 99, 104, 131; 194/4 C

[56] References Cited

U.S. PATENT DOCUMENTS

| | | | |
|---|---|---|---|
| 2,616,477 | 11/1952 | Scheer et al. | 100/131 |
| 3,792,765 | 2/1974 | Arp | 194/4 C |
| 3,907,087 | 9/1975 | Tanaka | 194/4 C |
| 4,141,493 | 2/1979 | Arp | 100/902 X |
| 4,345,679 | 8/1982 | Dewoolfson | 100/902 X |

FOREIGN PATENT DOCUMENTS

| | | | |
|---|---|---|---|
| 2346147 | 10/1977 | France | 100/902 |
| WO81/02802 | 10/1981 | PCT Int'l Appl. | 100/902 |

*Primary Examiner*—Billy J. Wilhite

[57] ABSTRACT

Machine for crushing cylindrical aluminium cans for beer, soft drinks etc. The machine comprises a can intake. A craddle for receiving the can in a substantially horizontal position is displacable between a receiving position in the can intake and a crushing position in a press device for squeezing the cans axially between the end walls thereof. The displacement of the craddle between said position is effected by displacement of a closure member for the can intake between opened and closed positions. A perforated sloping plane is arranged below the press device for receiving the crushed can falling down from the press device at the return movement thereof after crushing, and diverting the crushed can to a collecting container.

8 Claims, 6 Drawing Figures

MACHINE FOR CRUSHING CYLINDRICAL ALUMINIUM CANS FOR BEER, SOFT DRINKS ETC.

The present invention relates to a machine for crushing cylindrical aluminium cans for beer, soft drinks etc, comprising a can intake and a press device for squeezing the cans axially between the end walls thereof.

The use of aluminium cans for the distribution of beer and soft drinks has increased the necessity of recovering the empty cans for reuse of the aluminum. In order to accomplish at all the recovery of the cans at reasonable costs it is necessary to crush the bulky cans to compact shape, and for this purpose machines of the type referred to above have been developed.

The invention contributes to the efforts of facilitating and popularizing the recovery of aluminium cans by providing a machine of the kind referred to which is well suited to be used by the public without detailed instructions for the operation of the machine, and which in a rational and safe manner receives the cans and crushes them while occuring residual liquid in the can is being separated; by experience it is known that the residual liquid averages to 10% of the original contents of the can. It is also intended to make possible by the invention an extensive automation of the function of the machine and to provide a built-in security for substantially empty aluminium cans only being processed in the machine.

Figure 1:
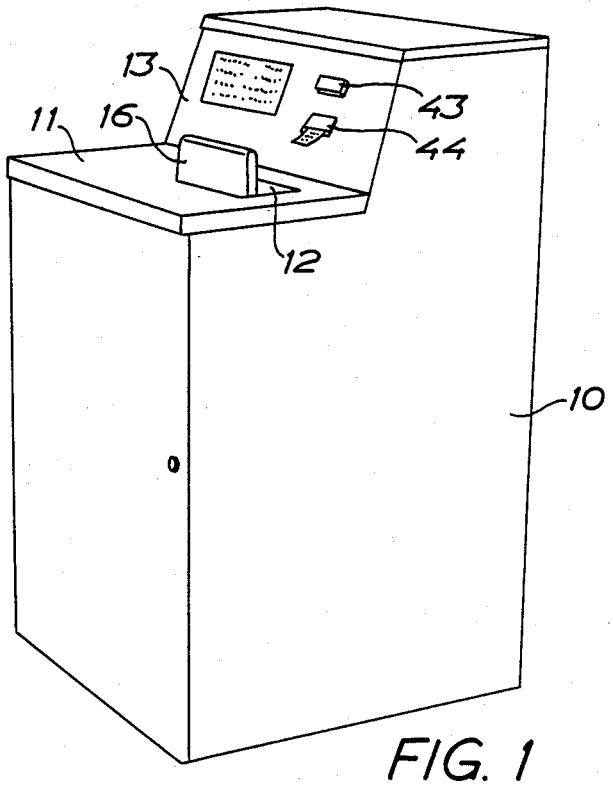
Figure 2:
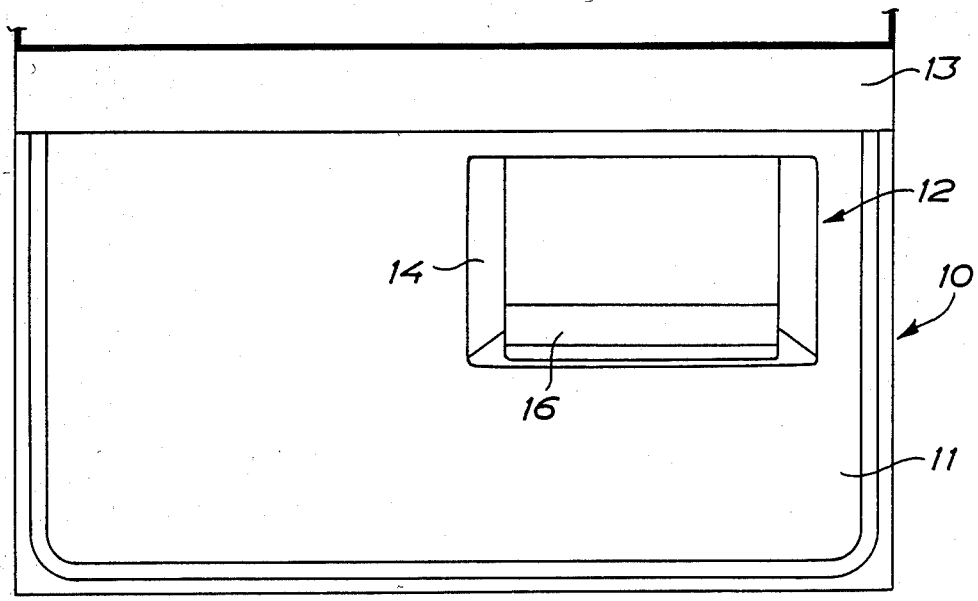
Figure 3:
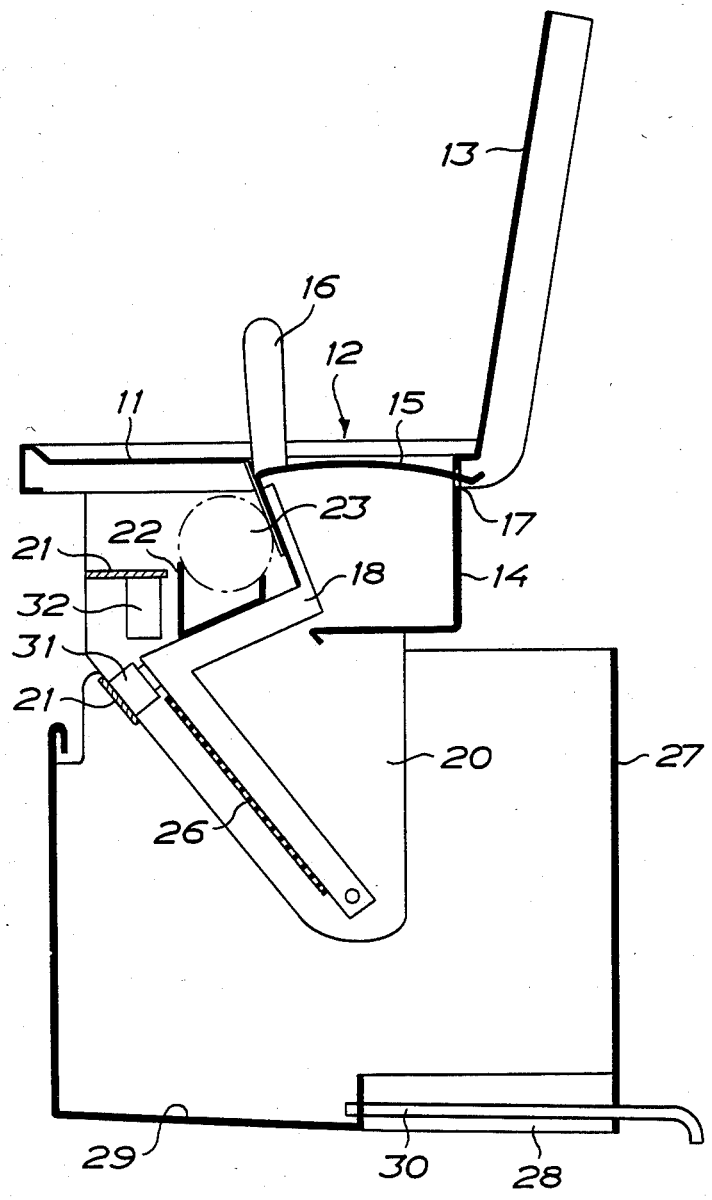
Figure 4:
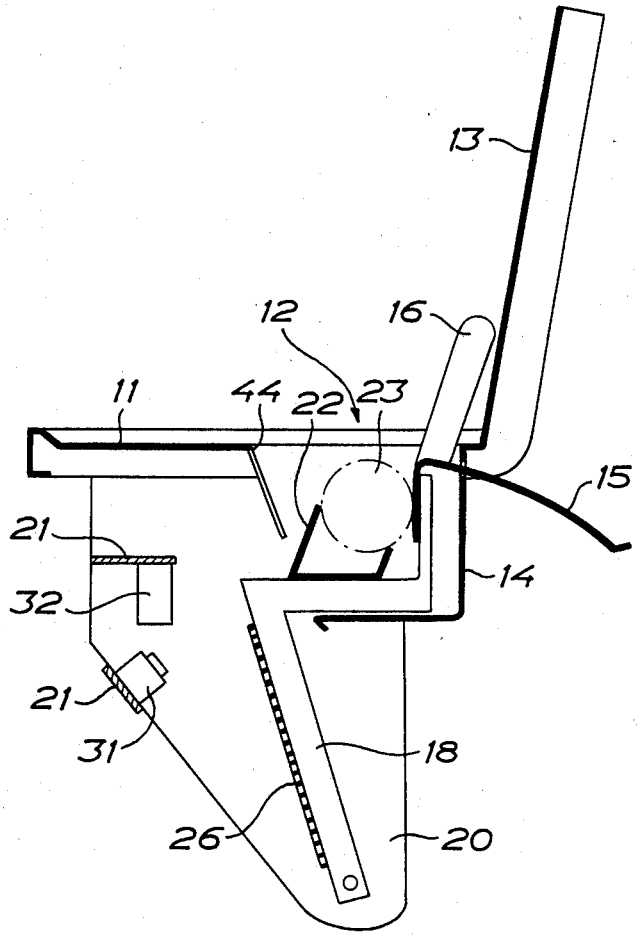
Figure 5:
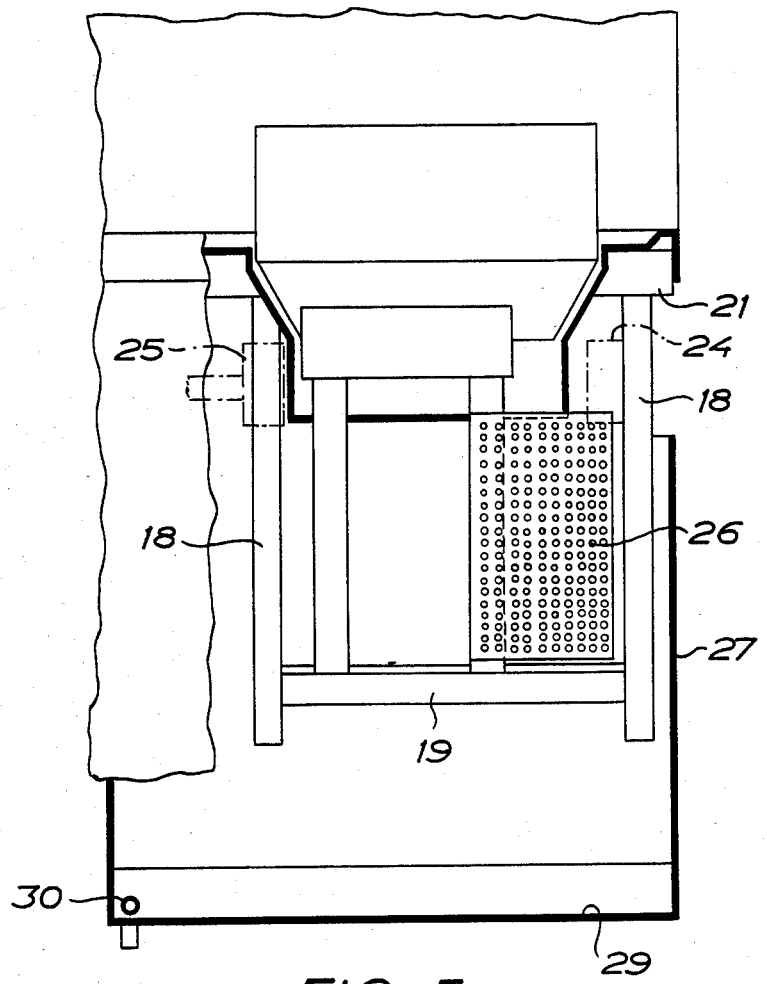
Figure 6:
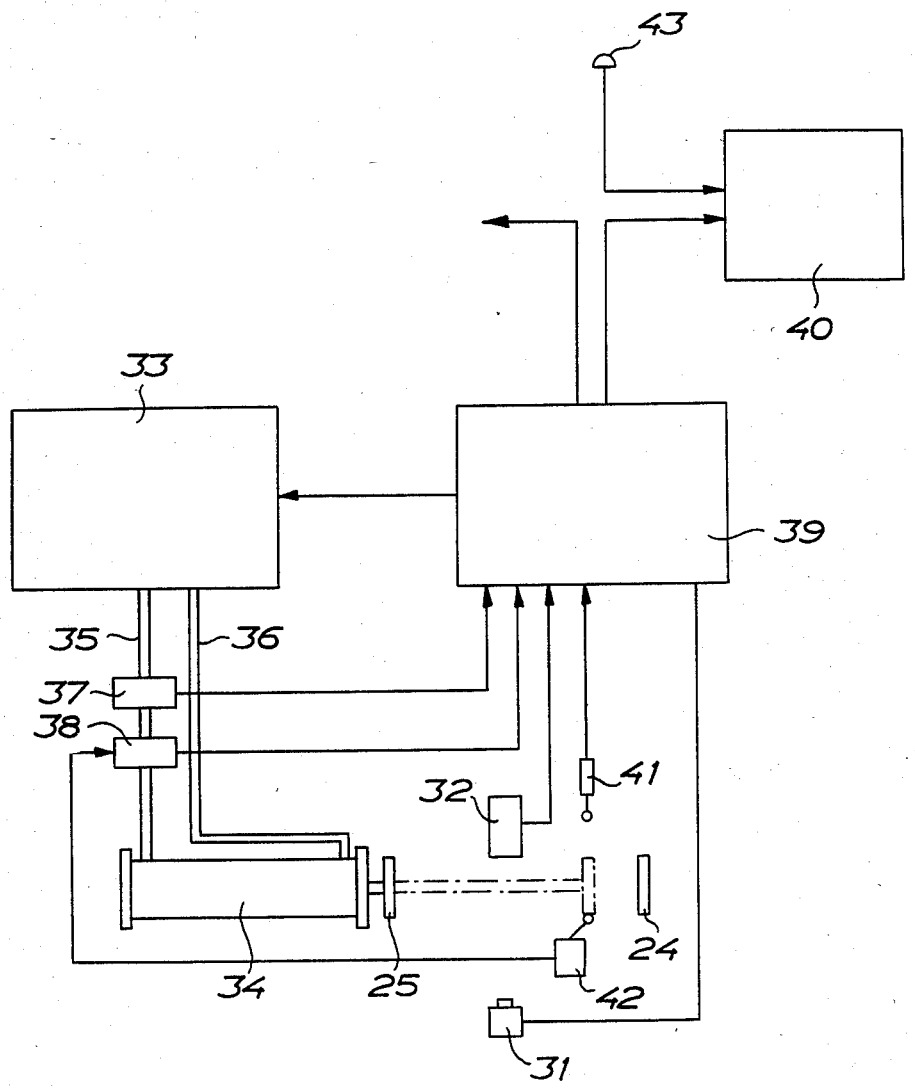

For said purpose the invention provides a machine of the type referred to herein with the characteristics appearing from claim 1, and in order to explain the invention in more detail an embodiment of this machine will be described below with reference to the accompanying drawings in which FIG. 1 is a perspective view of the machine, FIG. 2 is a plan view of the machine table with a can intake arranged therein, FIG. 3 is a partial vertical cross sectional view of the machine through the can intake with a craddle for receiving the can in position for crushing, FIG. 4 is a view similar to that of FIG. 3 with the craddle in a receiving position, FIG. 5 is a partial vertical cross sectional view perpendicular to the views of FIGS. 3 and 4 with the craddle in the receiving position, and FIG. 6 is a diagram over the operative hydraulic and electric systems of the machine.

Referring to FIGS. 1 and 2 the machine comprises a metal sheet cabinet 10 with a table top 11 in which a can intake 12 is provided, and an operation and instruction panel 13 which projects from the table slightly inclined backwards. The cabinet 10 encloses the operative hydraulic and electric systems of the machine and a suitable collecting receptacle for the crushed aluminium cans and includes a suitable frame as well as doors for access to the interior of the cabinet at maintenance and repair work. The device for receiving the aluminium can delivered to the can intake 12 is shown in more detail in FIGS. 3 to 5. According to these FIGS. the can intake comprises a receiving hopper 14 which can be closed at the top thereof by means of a slide cover 15 having a handle 16 projecting from the table top 11. The slide cover 15 can be displaced between opened and closed positions through a slot 17 in the receiving hopper 14 and is mounted at one end of two arms 18 the other ends of said arms being interconnected by means of a cross bar 19. At the cross bar the arms are mounted for pivotal movement about a horisontal axis in heavy bearing flanges 20 supported by the frame of the machine, which is fragmentarily indicated at 21, FIG. 5. The arms 18 are substantially Z-shaped and on the web extending between the end portions thereof a craddle 22 is mounted for receiving an aluminium can in a horizontal position. In FIGS. 3 and 4 a can is indicated by dot-and-dash lines at 23. Preferably, the arms 18 are normally held in the position according to FIG. 3 either by gravity or by means of a spring, and in this position the can intake 12 is locked by the slide cover 15 closing the receiving hopper 14. For the insertion of a can the slide cover 15 is slid backwards to the position according to FIG. 4 at the handle 16 such that the receiving hopper will be opened and a can 23 can be laid down onto the craddle 22. Thus, FIG. 4 shows the craddle in the receiving position thereof. Then, the slide cover 15 is closed the arms 18 being swung counter-clockwise from the position of FIG. 4 so that the craddle 22 will arrive at the position according to FIG. 3, which is a crushing position. In the crushing position according to FIG. 3 the can 23 received by the craddle 22 is located between a stationary press jaw 24 indicated by dot-and-dash lines in FIG. 5, and a movable press jaw also indicated by dot-and-dash lines at 25 in FIG. 5, which is connected to a hydraulic cylinder. When the hydraulic cylinder is pressurized the can will be squeezed axially between the end walls thereof to form a compact body adjacent the stationary press jaw 24, said compact body then falling down at the return movement of the movable press jaw 25.

For the reception of the aluminium can crushed to form a compact body, when it falls down from the press device, a perforated metal sheet 26 is supported by one arm 18, and when the arms 18 are in the crushing position according to FIG. 3 said sheet is held in a sloping position below the press device. Thus, the compact body will land on the sheet and will roll or slide down the sheet.

A trough 27 is located below the receiving and press devices and forms an opening 28 in the bottom thereof, which is located such that the compact body, falling down from the sloping metal sheet 26 will fall down through said opening connecting to a receiving cardboard box or a bag, not shown, which should by placed inside the cabinet 10. However, residual liquid may be left in the can, and this liquid will be pressed out during crushing and such liquid can also partly drain off already when the can is placed in a horizontal position in the craddle 22 of the can intake 12. The liquid draining off or being pressed out of the can in this manner will flow onto the bottom 29 of the trough 27, which slopes somewhat towards a drain tube 30 connecting to a container, not shown, for receiving the liquid drained off.

It is, of course, important that a machine of the type referred to herein is constructed in such a way that bodily injuries cannot occur when the machine is being used, e.g. by a hand being introduced into the press device when it is put into operation. The slide cover 15 prevents that a hand is moved through the receiving hopper 14 into the press device when the craddle 22 is in the crushing position and the press device is ready to operate. In the closed position the slide cover 15 should be latched, and for this purpose an electromagnet 31 supported by the frame 21 of the machine is arranged to attract the rocker formed by the arms 18, when the craddle 22 is in the crushing position according to FIG.

3. If it should occur due to a defectiveness in the operative systems of the machine, that the operation of the press device starts before the slide cover 15 is completely closed and locked in the closed position, the craddle 22 will be located between the press jaws 24 and 25 and will prevent the jaws from closing. Therefore, the craddle should be of a construction which is sufficiently sturdy to with-stand the pressure from the movable press jaw 25.

It is also important that the machine cannot be misused by objects, e.g. of glass or cardboard, resembling cans being supplied to the machine for crushing. Therefore, a sensor 32 is arranged adjacent the position occupied by the craddle 22 for crushing a can received by the craddle. The sensor is of the inductive type for sensing non-magnetic metals. The sensor accordingly responds to aluminium cans and, of course, also to cans of other non-magnetic metals, but it is more unlikely that a can e.g. of copper, brass, stainless steel or the like will be supplied to the machine. However, the sensor does not respond to cardboard containers, cans of iron sheet, glass jars etc. A suitable sensor for this purpose is VariKont (registered trade mark) from Pepperl-+Fuchs, Mannheim, BRD.

The operative hydraulic and electric systems of the machine are generally and diagrammatically shown in FIG. 6. The machine comprises a hydraulic pump unit 33 which is driven by an electric motor and can be of a conventional construction available on the market. The pump unit is connected to a double-acting hydraulic cylinder 34 the piston rod of which supports the movable press jaw 25 hydraulic conduits for the working motion and the return motion of the movable press jaw being shown at 35 and 36, respectively. In the hydraulic conduit 35 for the working motion there is arranged a pressure switch 37 for a predetermined higher pressure, e.g. 400 kp, and a pressure switch 38 for a predetermined lower pressure, e.g. 100 kp. These pressure switches are both connected to a computer 39 also the elctromagnet 31 and the sensor 32 being connected to said computer. The computer is connected to the hydraulic pump unit 33 and to the printer 40. It can also be connected to indicators of different kinds as is indicated in FIG. 6.

The computer 39 is programmed to provide, in cooperation with switches and functional units connected therewith, the following operating cycle of the machine.

When an aluminium can has been supplied to the can intake and has been positioned in the craddle 22 and when the craddle has been displaced to the crushing position according to FIG. 3, the sensor 32 supplies a signal to the computer 39 in order that the computer shall energize the electromagnet 31 and start the hydraulic pump unit 33. However, if the can supplied is not of aluminium (or another non-magnetic metal) no start signal will be supplied to the pump unit 33. Possibly, starting of the pump unit may also be dependent on the actuation of a responding contact 41 which is actuated and supplies a signal to the computer 39 when the craddle 22 has arrived at the crushing position according to FIG. 3. The contact 41 can be actuated by the rocker formed by the arms 18, or by an element connected with said rocker. The hydraulic cylinder 34 will now be driven by the pump unit 33 to advance the the movable press jaw 25 while the can in the craddle 22 being squeezed against the stationary press jaw 24. When the working stroke has been completed the hydraulic pressure in the hydraulic cylinder 34 will be reversed in order that the movable press jaw 25 shall make the return stroke thereof and return to the rest position. The movement of the movable press jaw 25 can be reversed in a known manner by means of limit switches or the like. When the movable press jaw 25 returns, the compact body formed by the squeezed can will fall down via the sloping perforated metal sheet 26 and the trough 27 through the opening 28 to be received by the collection bag or container.

If the can supplied is made of aluminium (or another non-magnetic metal) nothing will happen in the machine; it will be necessary to remove the can again from the can intake so as to condition the intake for the supply of such cans as should be processed by the machine, viz. aluminium cans.

If the can supplied is filled to a major part by liquid, stones, nails or the like, the pressure force will increase and eventually will reach the maximum value which has been preset in the pressure switch 37, said switch supplying a signal to the computer 39. The computer in turn, by a signal to the pump unit, switches the hydraulic cylinder 34 for the return movement such that the movable press jaw 25 immediately returns to the rest position. Also in this case it is accordingly necessary to remove the can supplied from the can intake 12 in order that the machine will again operate normally.

The machine is constructed in such a way that the aluminium can supplied will be crushed to a height of e.g. 20 millimeters before the movable press jaw 25 returns. Some millimeters from said reversing position a limit switch 42 is arranged and this switch is connected to the computer 39 via the pressure switch 38 to provide a signal only if the pressure preset in the pressure switch 38 has been reached. If this pressure will not be reached, no signal will be supplied to the computer. The signal from the limit switch 42 shall initiate a signal from the computer 39 to the printer 40 for counting the aluminium cans supplied as they are crushed in the machine. Due to the fact that the signal from the limit switch 42 is supplied to the computer 39 via the pressure switch 38 it is achieved that a relatively soft object e.g. a cardboard roll with an external aluminium foil will not be counted as an aluminium can. Thus, it is out of the question that a person tampers with the machine in this manner. When one and the same customer has supplied the number of aluminium cans which are to be disposed off, the printer 40 will be started by depressing a push botton 43, confer also FIG. 1, for the supply of a printed tape from the printer. The tape will be supplied from the machine at 44, FIG. 1, and will be torn off in order that the slip obtained shall be used as a receipt for cans delivered. The printer can be of any conventional type. It should, of course, be zeroed after each depression of the push botton 43.

The computer 39 should include necessary functions for providing an indication when the number of cans that have been processed in the machine corresponds to a filled collection bag or container, and for indicating that the tape in the printer has run out or that a defectiveness has arisen in the machine. Neither the computer per se nor the details of these and other functions of the machine will be described here because there would be no difficulties involved at the present state of the computer art in constructing a computer with a programme which controls the functions described.

The machine shown and described can be modified as to the construction thereof within the scope of the accompanying claims. This is true especially as far as the means for receiving the aluminium cans and transferring these cans to the crushing position are concerned. A rocker arrangement has been shown herein but it is possible to use instead a slide arrangement or the like. Also the trough 27 can be arranged in other ways than that shown herein, and this is, of course, true also with regard to the construction and form of the cabinet 10.

Preferably, the can intake 12 should be dimensioned in such a way that a can resting in the craddle 22, abuts the edge 44 if it is one millimeter or two larger than a common aluminium can so that the can will be wiped off from the craddle 22 and cannot be delivered to the machine for crushing. Instead of the edge 44 being used as a wiper a separate wiper can, of course, by arranging in the passageway between the receiving position of the craddle and the crushing position thereof.

We claim:

1. Machine for crushing cylindrical aluminium cans for beer, soft drinks, etc, comprising a can intake, a press device for squeezing the cans axially between the end walls thereof, a craddle for receiving the can in a substantially horizontal position, a closure member for the can intake, said craddle being placable between a receiving position in the can intake and a crushing position in the press device by displacement of the closure member between opened and closed positions, a collecting container, and a perforated sloping plane arranged below the press device for receiving the crushed can falling down from the press device at the return thereof after crushing and for diverting the crushed can to the collecting container.

2. Machine as claimed in claim 1, further comprising a hopper with an outlet opening with the perforated sloping plane arranged in said hopper, the lower end of the plane being located adjacent said outlet opening, and a trough in said hopper for receiving residual liquid from the can transferred to the press device, when being crushed in the press device.

3. Machine as claimed in claim 2, wherein the trough is provided with a drain for connection to a liquid container.

4. Machine as claimed in claim 1, wherein the craddle is arranged on a rocker.

5. Machine as claimed in claim 4, wherein the perforated sloping plane is arranged on the rocker below the craddle to be displaced together with the craddle and to take a position below the press device with the craddle in the crushing position.

6. Machine as claimed in claim 1, further comprising a sensor responsive to aluminium, which is operatively connected to the control system of the press device and is arranged adjacent the crushing position of the press device to inhibit the operation thereof unless an aluminium can is located in the craddle when it is in the crushing position.

7. Machine as claimed in claim 1, further comprising a hydraulic pump system for the operation of the press device and including a pressure switch operatively connected to the press device for initiating the return movement of said device at a predetermined higher pressure in the hydraulic pump system at the crushing operation.

8. Machine as claimed in claim 7, further comprising a second pressure switch in the hydraulic pump system for inhibiting the signal from said sensor at a pressure in the hydraulic pump system which is below a predetermined lower pressure.

* * * * *